US005789328A

United States Patent [19]

Kurihara et al.

[11] Patent Number: 5,789,328

[45] Date of Patent: Aug. 4, 1998

[54] BULKY NONWOVEN FABRIC AND METHOD FOR PRODUCING THE SAME

[75] Inventors: Kazuhiko Kurihara, Itabashi-ku; Hiroshi Yazawa, Kunitachi; Sadayuki Ishiyama, Setagaya-ku; Jun Yamada, Yokosuka, all of Japan

[73] Assignees: Nippon Petrochemicals Company, Limited; Polymer Processing Research Inst., Ltd., both of Japan

[21] Appl. No.: 878,343

[22] Filed: Jun. 18, 1997

[30] Foreign Application Priority Data

Jun. 18, 1996 [JP] Japan ..... 8-177537

[51] Int. Cl.[6] ..... B32B 5/06

[52] U.S. Cl. ..... 442/387; 28/104; 28/107; 28/112; 156/85; 156/229; 428/105; 428/910; 442/358; 442/414

[58] Field of Search ..... 442/352, 358, 442/366, 387, 383, 384, 408, 402, 414; 28/104, 107, 112; 428/910, 105; 156/85, 229

[56] References Cited

FOREIGN PATENT DOCUMENTS

| | | |
|---|---|---|
| 97-306823 | 6/1995 | European Pat. Off. . |
| 0 703 308 A1 | 3/1996 | European Pat. Off. . |
| 08109563 | 4/1996 | European Pat. Off. . |
| 08170263 | 7/1996 | European Pat. Off. . |
| 3-36948 | 6/1989 | Japan . |
| 2-182963 | 7/1990 | Japan . |
| 2-242960 | 9/1990 | Japan . |
| 2-269859 | 11/1990 | Japan . |
| 4-24216 | 1/1992 | Japan . |
| 4-41762 | 2/1992 | Japan . |
| 4-316608 | 11/1992 | Japan . |
| 6-315470 | 11/1994 | Japan . |
| WO 93/20271 | 10/1993 | WIPO . |
| WO 96/17121 | 6/1996 | WIPO . |

*Primary Examiner*—James J. Bell
*Attorney, Agent, or Firm*—Scully, Scott, Murphy & Presser

[57] ABSTRACT

The object of the present invention is to provide a nonwoven fabric which is excellent in bulkiness and touch feeling as well as strength and dimensional stability and to provide a method for producing the above nonwoven fabric through a simple and convenient manner without employing any particular spinning device. The invention relates to a bulky nonwoven fabric composed of a stretched filament web which is prepared from either at least one layer of a stretched unidirectionally arranged filament web which is composed of almost unidirectionally arranged long fibers being stretched and shrunk or a stretched crosswise laminated filament web made of two or more layers of the stretched unidirectionally arranged filament webs and a short fiber web which is entangled with said stretched filament web and is crimped as a result of shrinkage of the long fibers, and a method for producing the same.

10 Claims, 5 Drawing Sheets

(A)

(B)

(C)

BULKY NONWOVEN FABRIC AND METHOD FOR PRODUCING THE SAME

BACKGROUND OF THE INVENTION

1. Field of the Invention

The present invention relates to a bulky nonwoven fabric and a method for manufacturing the same. More particularly the invention relates to a nonwoven fabric having excellent strength and bulkiness and a method for producing the same, in which method a stretched filament web prepared by stretching a filament web made of long fibers is combined with a short fiber web having a smaller shrinkage factor than that of the former stretched filament web to intertwine together with each other, and after that, the stretched filament web is allowed to shrink.

2. Description of Prior Art

Examples of conventional bulky nonwoven fabrics in which conjugate filaments or the like are used includes those disclosed in Japanese Patent Laid-open Publication No. 4-24216 (1992) (Short fiber nonwoven fabric), No. 2-182963 (1990) (Spunbonded nonwoven fabric), No. 4-41762 (1992) (Spunbonded nonwoven fabric), No. 4-316608 (1992) (Spunbonded nonwoven fabric), and a prior art filed by the present inventors, PCT Publication WO 96/17121.

However, in order to produce these conventional bulky nonwoven fabrics, a spinning die provided with expensive conjugate nozzles, or mixed spinning dies are required. In addition, at least two sets of extruders are also necessary, so that the cost for the apparatus is expensive. Furthermore, because the structure of nozzles is complicated, resin-rich area is liable to be formed, so that fibers of excellent quality cannot be produced. Besides, because the co-extrusion of different type polymers is done, the allowable range of operating conditions is narrow so that the productivity is low. In addition to the above, there is also difficulty in maintenance and checking up of equipment overhauling owing to its complicated structure.

The nonwoven fabric is inexpensive and it has softness or bulkiness (low bulk density), which are different from woven fabrics. So that, the utilities of nonwoven fabric is being expanded in a variety of fields.

Meanwhile, the strength of nonwoven fabric is low than that of woven fabric and the basis weight of the former is uneven, so that the practical strength of the resultant product is low. In this respect, in order to make the best use of characteristics inherent in nonwoven fabric, it is intended to improve the bulkiness of nonwoven fabric product with utilizing the technique of the above described conjugate method.

Since the nonwoven fabric must be inexpensive and the applications thereof extend over a wide range, it is required to produce nonwoven fabric through a production method which is suitable for producing a wide variety of small-lot products. Moreover, it is difficult to produce a nonwoven fabric having both sufficient strength and bulkiness in conventional methods. In addition, there are disadvantages in that a nonwoven fabric of excellent bulkiness was poor in dimensional stability, and the dimension of fabric is easily changed with small tension, so that its configuration is unstable.

As described above, with respect to the method for manufacturing nonwoven fabrics, it is required to solve the problems in strength, uniformity and dimensional stability. It is also required to improve the characteristic features of bulkiness and touch feeling. Moreover, it is desirable that the manufacturing method is suitable for the economical advantage of low cost production and also suitable for producing a variety of small-lot products. In this respect, the above-mentioned method employing complicated equipment for the conjugate spinning or for mixed spinning, is not suitable in view of higher cost and the applicability to the production of many kinds of products of small quantities.

BRIEF SUMMARY OF THE INVENTION

In order to remove the disadvantages involved in conventional nonwoven fabrics such as low strength, poor dimensional stability, and unevenness in basis weight, the present inventors made extensive inventions, in which nonwoven fabrics were stretched, or they were optionally laminated as disclosed in Japanese Patent Publication No. 3-36948 (1991), Japanese Patent Laid-open Publication No. 2-269859 (1990) and No. 2-242960 (1990). Furthermore, the invention disclosed in Japanese Patent Application No. 6-315470 (1994) was traced to carry out the improvement in bulkiness and touch feeling treatment.

The present invention is the one which is attained by improving and developing further the above described prior invention made by the present inventors. It is, therefore, the objects of the invention to provide a nonwoven fabric which has excellent strength and dimensional stability, improved bulkiness and touch feeling. In addition, the object of the present invention is to provide a method for manufacturing the nonwoven fabric described above with the use of simplified means without employing any particular spinning equipment.

As a result of the investigation for solving the above-mentioned problems, it has been found out that a short fiber web having a different heat shrinkage factor is laminated or laid down together with a stretched filament web prepared by stretching a nonwoven fabric made of long fibers spun from a thermoplastic resin to intertwine together with each other, and then, the obtained intertwined material is heat-treated to shrink the long fibers of the above stretched nonwoven fabric and is applied with crimping to the short fibers of the aforesaid short fiber web, whereby a nonwoven fabric being excellent in bulkiness, touch feeling, and appearance is obtained. Thus the present invention has been accomplished.

More specifically, the present invention relates to a bulky nonwoven fabric which is composed of a unidirectionally arranged stretched filament web or a transversely laminated stretched filament web and a short fiber web. The unidirectionally arranged stretched filament web is prepared from at least one layer of long fibers which are shrunk after stretching and arranged almost in one direction. The transversely laminated stretched filament web is made by transversely laminating two or more layers of the unidirectionally arranged stretched nonwoven fabric. The short fiber web is intertwined with the aforesaid stretched filament web and crimped as a result of the shrinkage of the aforesaid long fibers. The bulky nonwoven fabric of the present invention is further characterized in that the stretching ratio of the above unidirectionally arranged stretched nonwoven fabric is 3 to 20, an average fineness of fibers is 0.01 to 10 denier, and a basis weight is 1 to 80 g/m$^2$.

Furthermore, the present invention relates to a bulky nonwoven fabric which is composed of a unidirectionally arranged stretched nonwoven fabric or a transversely laminated stretched nonwoven fabric and a short fiber web which is made of natural fibers, regenerated cellulose fibers or synthetic fibers. The unidirectionally arranged stretched nonwoven fabric is prepared from at least one layer of long fibers which are spun from a thermoplastic resin and arranged almost in one direction and the transversely laminated stretched nonwoven fabric is made by transverse laminating two or more layers of the unidirectionally arranged stretched nonwoven fabric. The short fiber web is intertwined with the aforesaid stretched nonwoven fabric and crimped as a result of the heat treatment of the aforesaid long fibers.

Moreover, the present invention relates to a method for manufacturing a bulky nonwoven fabric which method is characterized by the steps of laminating a short fiber web to a stretched filament web selected from either of at least one layer of a stretched unidirectionally arranged filament web wherein stretched long fibers are substantially unidirectionally arranged or a transversely laminated stretched filament web produced by laminating two or more of the above stretched unidirectionally arranged filament webs so that the axes of the fiber arrangement are intersected with each other, to intertwine the short fiber web with the stretched filament web, and then heat-treating the nonwoven fabrics to cause the shrinkage of the long fibers of the stretched filament web and to crimp the short fibers of the short fiber web.

In the above-mentioned manufacturing method, the aforesaid stretched unidirectionally arranged filament web is prepared by stretching unidirectionally a nonwoven fabric composed of unstretched long fibers spun from a thermoplastic resin, and the long fibers of the nonwoven fabric are arranged substantially in one direction, while the above-mentioned intertwining is carried out by laminating a short fiber web to the stretched filament web and applying high-pressure water jet of 10 to 300 kg/cm$^2$ to the laminate.

Furthermore, the stretched unidirectionally arranged filament web employed in the above-mentioned method is characterized in that the stretching ratio is 3 to 20, the average fineness is 0.01 to 10 denier, and the basis weight is 1 to 80 g/m$^2$.

Moreover, a filament web made of polyolefin or polyester and having 15% or more in the absolute value of shrinkage factor is employed as the stretched material, which is selected from either the aforesaid stretched unidirectionally arranged nonwoven fabric or stretched transversely laminated filament web prepared by laminating two or more layers of the former stretched unidirectionally arranged filament webs in such that the axes of arrangement of fibers are intersected with each other. While the nonwoven fabric made of a natural fiber, a regenerated cellulose fiber, or a synthetic fiber and having 5% or less in absolute value of shrinkage factor is employed as the aforesaid short fiber web in the above described producing method.

In addition, nonwoven fabrics made by the following methods may also be used as the aforesaid stretched unidirectionally arranged nonwoven fabric in the method for manufacturing a bulky nonwoven fabric according to the present invention. One of them is a long fiber nonwoven fabric prepared by spinning unoriented fibers of a thermoplastic resin is so stretched unidirectionally that the fibers composing the nonwoven fabric are stretched substantially to cause molecular orientation. The stretched unidirectionally arranged filament web is made by another method in which a filament formed by spinning out a thermoplastic resin from a spinneret is allowed to revolve or to swing transversely, and the filament is scattered in the direction perpendicular to the spinning direction while drafting the same by applying at least one pair of opposed fluids being substantially symmetrical to the revolving or swinging single filament from the both sides thereof and centering around the filament in a state where the filament is still drafted at a degree of two or more times drafting, whereby an arranged nonwoven fabric is obtained as a result of arranging fibers in the scattered direction, and the nonwoven fabric thus obtained is stretched in the arranged direction.

BRIEF DESCRIPTION OF THE DRAWINGS

The present invention will become more fully understood from the detailed description given hereinafter and the accompanying drawings, which are given by way of illustration only, and thus are not limitative of the present invention, in which.

DETAILED DESCRIPTION OF THE INVENTION

Figure 1:
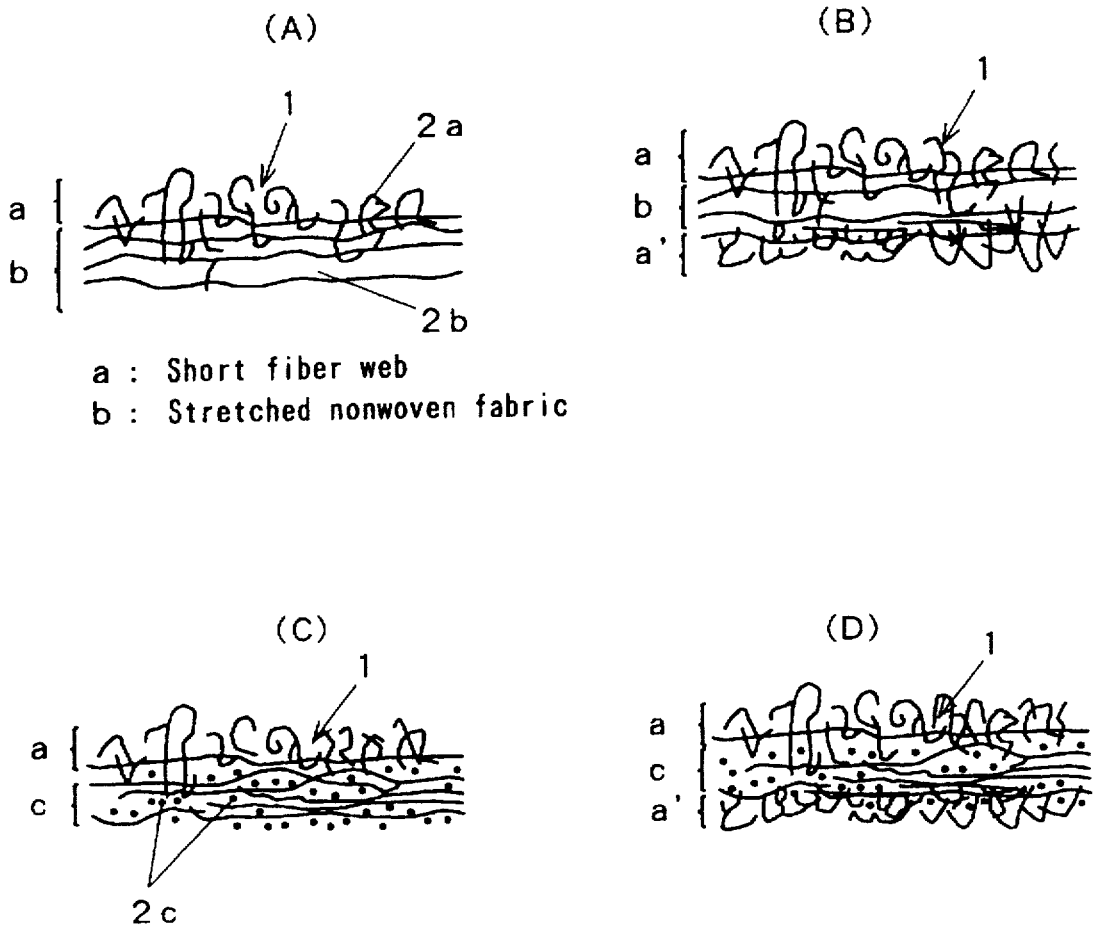
FIGS. 1 (A) through 1 (D) are partially enlarged cross-sectional view each showing schematically a bulky nonwoven fabric.

The present invention will be described in more detail hereinafter.

Because the present invention utilizes the measure that a stretched nonwoven fabric selected from either one of a stretched unidirectionally arranged nonwoven fabric or a transversely laminated stretched nonwoven fabric, is intertwined with a short fiber web, and the obtained laminate is shrunk after the intertwinement, a plurality of nonwoven fabrics or webs having different shrink characteristics are required in a shrinking process after the intertwining. At least one of a plurality of nonwoven fabrics or webs to be intertwined is a stretched nonwoven fabric which is prepared by stretching unidirectionally a filament web composed of long fibers in order to utilize the shrink characteristics of stretched nonwoven fabric. More specifically, a combination of a stretched nonwoven fabric composed of long fibers having a large shrinkage factor with a short fiber web composed of short fibers having a comparatively small shrinkage factor is utilized, both the fabric and the web are heat-treated after the intertwining. As a result, the long fibers composing a nonwoven fabric or a web (shrunk web) having a large shrinkage factor shrink, while the short fibers composing a nonwoven fabric or a web (low shrunk web) curl to give the bulkiness. In the present invention, the absolute value of the shrinkage factor of the stretched non-woven fabric as a shrinkable web is 15% or more, while the absolute value of the shrinkage factor of the short fiber web as a less shrinkable web is 5% or less. The difference between the shrinkage factors of both the webs is at least 10% or more, and preferably 30% or more at a shrinkage temperature. The method for the shrinkage is not limited to heat treatment, but there is also a case in which the shrinkage is caused to occur in the presence of a swelling agent such as water. A self-expanding nonwoven fabric under heating is also included in the nonwoven fabrics having different shrinkage characteristics. In this case, the shrinkage factor is calculated as a minus value. Furthermore, the shrinkage factor is calculated on the basis of the amount of dimensional change in the form of a nonwoven fabric or a web.

The polymers as raw materials for long fibers of the stretched filament web used for the present invention are exemplified by polyolefin resins such as polyethylene, polypropylene; other thermoplastic resins such as polyester, polyamide, polyvinyl chloride resin, polyurethane, fluorocarbon resins; and modified resins of them. Moreover, fibers prepared by wet-spinning or dry-spinning of polyvinyl alcohol resin or polyacrylonitrile resin may also be used. Fibers made of polyolefin resins and polyester are preferably employed.

The long fibers composing the stretched nonwoven fabric used in the present invention are formed into the stretched nonwoven fabric in a state where the long fibers are scarcely stretched (unstretched or unoriented state). The unoriented fibers exhibit the following characteristic properties:

(1) They have a low tensile strength at yield point, so that they can be stretched by means of small force.

(2) They can be stretched sufficiently at a suitable temperature, so that they exhibit elongation of several hundreds percent.

(3) The fibers which were stretched at a suitable temperature exhibit high strength at room temperature.

With the characteristic properties as listed above, when unoriented fibers are stretched under a suitable temperature, fibers having sufficient strength can be obtained. When a nonwoven fabric composed of unoriented fibers is stretched under a suitable stretching temperature, the whole nonwoven fabric is stretched by the tension which is either lower than the intertwined strength of the long fibers or substantially equal tension. In this case, although the fibers themselves are stretched, the rearrangement of the fibers occurs in the course of stretching of the whole nonwoven fabric, so that the whole texture thereof is arranged in the stretched direction.

As a means for spinning raw fabric webs for the stretched nonwoven fabric used as a shrunk web in the present invention, a conventional spinning device of melt-blow die type or spun-bonded nozzle type may be employed. In addition, a device of unidirectionally arranged spinning type disclosed in Japanese Patent Publication No. 3-36948 (1991) or a spinning means of fluid straightening type disclosed in Japanese Patent Laid-open Publication No. 2-269859 (1990) may also be employed.

The basic different point of the above described spinning means from the spinning in a conventional spun-bonded type method is that fibers are positively heated by means of infrared heating or hot air immediately after the spinning from nozzles, or fibers are taken off by employing, for example, hot air for air sucker while positively suppressing the molecular orientation of fibers at the time of spinning. As described above, by suppressing the molecular orientation of fibers, the stretchability in subsequent stretching process of a nonwoven fabric is made favorable.

The unidirectionally arranged stretched nonwoven fabric used for the present invention means the one wherein the nonwoven fabric composed of long fibers prepared from any of the above described thermoplastic polymers are unidirectionally stretched and long fibers are arranged in one direction as a whole. The molecular orientation is caused to occur substantially in the stretched long fibers. The strength of the fiber is 1.5 g or more per denier, preferably 2.5 g or more, and more preferably 3 g or more.

The long fibers as referred to in the present invention may be substantially those containing the greater part of long fibers. More particularly, most part of the long fibers is 100 mm or more in length, which is different from the conventional nonwoven fabric composed of usual short fibers of about 10 to 30 mm in length. Accordingly, in the unidirectionally arranged stretched nonwoven fabric or transversely laminated stretched nonwoven fabric may contain fibers which are partially cut off in the courses of spinning, stretching or laminating.

The stretching ratio of the unidirectionally arranged nonwoven fabric in the present invention is defined in accordance with the following equation with utilizing the interval of marks which are put at regular intervals in the stretching direction of a long fiber nonwoven fabric before stretching the same:

$$\text{Stretching Ratio}=L/L_0$$

in which L is the length between marks after stretching and $L_0$ is the length between marks before stretching.

In other words, the stretching ratio described herein means the value defined by the amount of dimensional change, as a whole, in the arrangement and orientation of fibers composing a filament web in the stretching process. Meanwhile the stretching ratio depends upon the types of polymer as a raw material of fibers composing the long fiber nonwoven fabric, spinning means for the long fiber nonwoven fabric, and stretching means for unidirectionally arranging fibers. The stretching ratio with which a necessary shrinkage factor of the long fiber nonwoven fabric for the present invention should be selected even when any of the raw material polymers or any of spinning and stretching means is employed. The stretching ratio of the stretched unidirectionally arranged nonwoven fabric in the present invention is in the range from 3 to 20, and preferably from 5 to 10.

As the stretching means for producing the stretched nonwoven fabric used in the present invention, a longitudinal stretching means, a transversely stretching means and a biaxially stretching means which have been used for the stretching of conventional films or nonwoven fabrics, can be adopted. The variety of stretching means disclosed in Japanese Patent Publication No. 3-36948 (1991) as filed by the present inventors, may also be used.

More particularly, the short distance stretching between rolls (hereinafter referred to as "short distance stretching") is suitable as a longitudinal stretching means, because stretching can be done without narrowing the width of material. In addition, several means such as rolling, hot-air stretching, steam stretching, hot-water stretching, and hot-platen stretching may also be used.

As a transversely stretching means, although a tentering machine employed for biaxial stretching of films may be used, pulley type transversely stretching method (hereinafter referred to as "pulley method") illustrated in Japanese Patent Publication No. 3-36948 (1991), or a transversely stretching method with the combination of grooved rolls (grooved roll method) are conveniently used.

As a biaxially stretching means, a simultaneously biaxially stretching machine of tenter type used for biaxial stretching of films may be used, however, it is possible to carry out the biaxial stretching by combining the above-described longitudinal stretching means with the transversely stretching means.

The average fineness of the thus formed unidirectionally arranged stretched nonwoven fabric is in the range from 0.01 to 10 denier, and preferably from 0.01 to 1 denier. Furthermore, the basis weight of the aforesaid nonwoven fabric is in the range from 1 to 80 g/m$^2$, and preferably from 3 to 10 g/m$^2$.

The term "stretching" herein referred to means generally that a material is stretched to cause molecular orientation to occur and the state of molecular orientation is substantially maintained after the stretching. Meanwhile, in some nonwoven fabric made of a material exhibiting rubber elasticity, molecular orientation is caused to occur by stretching but it returns reversibly to the original state when the tension of stretching is released, even such a nonwoven fabric is also included in the stretched nonwoven fabrics in the present invention so far as it exhibits molecular orientation in the stretching state.

Moreover, the molecular orientation is clearly discriminated from the arrangement of fibers in the present invention. That is, the term "molecular orientation" means the state in which molecules are arranged in a certain direction as average in a fiber, while the term "arrangement" means the state of lineup of a plurality of fibers.

The stretched unidirectionally arranged nonwoven fabrics in the present invention can be used alone or in combination of two or more in the state such that they are put in layers together without allowing the axes of arrangement to intersect. However, the nonwoven fabrics are often used in the form of a stretched transversely laminated nonwoven fabric in which a nonwoven fabric is laminated transversely with another nonwoven fabric. Most of them are perpendicularly laminated nonwoven fabrics which are prepared by laminating and bonding a longitudinally arranged layer and a transversely arranged layer together. They are not limited as far as fabrics are laminated in the state such that the axes of fiber arrangement intersect with each other. Besides the perpendicularly laminated fabric and obliquely laminated fabric, the nonwoven fabrics are multiplexedly laminated to intersect with each other in various directions, whereby strengths in various directions of fabrics can be balanced in the plane of laminated fabric.

The term "transverse lamination" used in the present invention means that the arrangement of fibers are intersected perpendicularly or obliquely with each other. In other words, it is sufficient that unidirectionally arranged layers are laminated in different directions. The term "arrangement of fibers" herein referred to does not mean the microscopic directions of respective fibers but the way of fiber arrangement in which the direction of a single long fiber represents the sum total of the whole fibers of the respective layers. For instance, the term "longitudinally arranged layer" means that fibers are arranged in longitudinal direction as a whole.

The transverse laminating method of the stretched transversely laminated nonwoven fabric in the present invention is represented by the laminating method using a transversely stretched nonwoven fabric and a longitudinally stretched nonwoven fabric disclosed in Japanese Patent Publication No. 3-36948 (1991) as filed by the present inventors (transversely-longitudinally stretching lamination: method 1) and the method using a longitudinally-transversely laminating machine (longitudinally-transversely lamination: method 2). In these methods, the axes of fiber arrangement are not necessarily required to be perpendicular with each other but they may be laminated somewhat obliquely with each other.

A variety of webs can be employed for the short fiber web in the present invention. Exemplified as the webs are those composed of short fibers made of regenerated cellulose fibers such as rayon and cupro-ammonium rayon; semi-synthetic fibers such as acetate fiber; natural cellulose fibers such as cotton, linter and pulp; and synthetic fibers or conjugate fibers, the shrinkage factor of which is limited to 5% or less by heat treatment, made of polyethylene, polypropylene, polyester, polyamide, polyacrylonitrile, and vinylon, and mixtures of them. In order to form webs, several methods are employed. For example, wet-spinning regenerated fiber or melt-spinning synthetic fiber through a conventional method, cutting the obtained fiber, and arranging yarns into a web by means of a carding machine; spinning fiber through melt-blow method to form a web; arranging natural fiber by means of a carding machine to form a web; and beating natural fiber and applying paper making method. Moreover, if desired, treatment such as heat treatment is carried out for reducing the shrinkage factor of a web.

The single yarn fineness of the above described short fibers is in the range of preferably from 0.05 to 20 denier (hereinafter referred to as "d") and more preferably from 0.1 to 6 d, while the length of the fiber is in the range of preferably from 5 to 60 mm and more preferably 10 to 51 mm. When the single yarn fineness is less than 0.05 d, the fiber is inferior in lint freeness. While if it exceeds 20 d, the touch feeling is inferior. Furthermore, when the length of fiber is less than 5 mm, the intertwining of the fiber is insufficient, so that the fiber exhibits low peel strength. While if it exceeds 60 mm, the dispersibility of the fiber decreases, so that both the cases are not desirable. The basis weight of short fiber web ranges preferably from 5 to 250 g/m$^2$, and more preferably from 10 to 100 g/m$^2$. When the basis weight of short fiber web is less than 20 g/m$^2$, the density of applied short fiber becomes uneven during the hydroentangling treatment. On the other hand, when it exceeds 250 g/m$^2$, the short fier becomes too dense, so that the adaptability to forming is not good. Accordingly, both the too large or too small quantities are not desirable.

As the method for intertwining the layers after laminating a stretched nonwoven fabric with a short fiber web having a shrink characteristic different from that of the stretched nonwoven fabric, it is possible to employ a variety of methods. The following methods are particularly effective for obtaining a soft and bulky nonwoven fabric having good touch feeling, which is an object of the present invention.

More particularly, there are several bonding methods such as the bonding with heat-embossing rollers, ultrasonic bonding, powder dot bonding, emulsion dot bonding method, through-air bonding method in which hot air is passed through fibers, water-jet bonding, needle punching method, and stitch bonding method. Among them, particularly preferable one is water-jet bonding method. By this method it is possible to intertwine a stretched nonwoven fabric with a short fiber web most effectively.

The bulky nonwoven fabric according to the present invention is characterized in that it has strength which is equivalent to the strength of woven fabric. That is, both the longitudinal and transversal strengths of the nonwoven fabric are 0.5 g/d or above, respectively, preferably more than 0.8 g/d, and more preferably more than 1.2 g/d. It should be noted that the reason why the strength herein is expressed by "per denier (d)" is that the comparison of strengths of nonwoven fabrics is difficult when usual measures of "per square centimeter" or "per 30 millimeter width" are used because the basis weights and bulk densities of nonwoven fabrics are different from one another.

Even the longitudinal strength of spun-bonded nonwoven fabric which is considered to have a comparatively high strength among conventional nonwoven fabrics, is around 0.4 to 0.8 g/d, and the transversal strength is less than 0.3 g/d, which strengths are far inferior as compared with that of woven fabrics and stretched nonwoven fabrics.

Furthermore, in view of "bulkiness" as a term to express the touch feeling of nonwoven fabric, the bulkiness of spun-bonded nonwoven fabric is not satisfactory either. There are many kinds of conventional nonwoven fabrics, particularly dry-bonded nonwoven fabrics composed of short fibers, have high in bulkiness, but the strength of such short fiber nonwoven fabric having high bulkiness is low.

The longitudinally stretched nonwoven fabric used as a stretched unidirectionally arranged nonwoven fabric in the present invention may also be used by spreading the width of the nonwoven fabric while maintaining the fiber arrangement in the longitudinal direction. Moreover, the transversely stretched nonwoven fabric may be also expanded in the longitudinal direction or fulled in the longitudinal direction, in which the basis weight of the nonwoven fabric can be controlled.

The method for shrinking the stretched nonwoven fabric is not especially limited, but usual methods by heating, swelling with a solvent, or the like can may be adopted. Among them, the heating method is preferable because it is possible to produce easily a bulky nonwoven fabric by shrinking uniformly the stretched nonwoven fabric without employing complicated processes or a special material such as conjugate fiber.

As the method by heating, a variety of methods generally used in heat-intertwinement of nonwoven fabric can be employed. For example, a stretched nonwoven fabric is shrunk by heating with the use of a heat chamber, through-air method, and heating with the use of calender rolls or embossing rolls. When the stretched nonwoven fabric is shrunk by heat-embossing method, the control for touch feeling and bulkiness can be attained without difficulty, because the degree of relief in short fiber web can be adjusted by the spacing of embossing dots, so that the heating with embossing rolls is most preferable in the present invention.

The above-mentioned shrinkage of a stretched nonwoven fabric is caused to occur by the shrinkage of stretched long fibers which compose the stretched nonwoven fabric.

The present invention will be described in more detail in connection with the manners of practice shown in the accompanying drawings.

FIGS. 1 (A) through 1 (D) are partially enlarged cross-sectional view each showing schematically the bulky nonwoven fabric according to the present invention. FIG. 1 (A) shows a bulky nonwoven fabric 1 which comprises a layer b composed of a stretched unidirectionally arranged nonwoven fabric in which long fibers shrunk after the stretching are substantially unidirectionally arranged and a layer a composed of a short fiber web in which crimping is caused to occur due to the shrinkage of long fibers. Both the layers lying one upon another in the thickness direction thereof. The long fibers 2*b* of the layer b are stretched and composes the stretched nonwoven fabric and which fibers are shrank after laminating and intertwining treatment, whereby tension is applied to these long fibers. The short fibers 2*a* composing the layer a are intertwined with the layer b and they are not so much shrunk when the long fibers 2*b* of the layer b are shrunk. As a result, the short fibers 2*a* are curled up, so that they have a number of bent portions partially.

FIG. 1 (B) illustrates the case in which a layer a, a layer b, and a layer a' are overlapped one another in this order along the thickness direction. The layer b is composed of long fibers which are stretched and then shrunk. The short fibers composing the layer a are curled on both the surfaces of the stretched nonwoven fabric, so that a number of bent portions are formed partially. Furthermore, the layer a' is composed of either the same short fiber web as that of the layer a, or another short fiber web made of a different raw material or made by a different method.

FIG. 1 (C) illustrates the case in which the aforesaid layer a is combined with a layer c prepared by crosswise laminating a pair of stretched nonwoven fabrics and then shrunk. In this case, for example, the layer c is prepared by laminating a longitudinally stretched nonwoven fabric on a transversely stretched nonwoven fabric in which they are substantially perpendicularly intersected with each other. It must be noted that the dots among long fibers 2*c* of the layer c in FIG. 1 (C) indicate cross-sections of fibers which are arrangement perpendicularly relative to the plane of the drawing.

FIG. 1 (D) illustrates the case in which the aforesaid layer c is combined with the layers a and a' to be laminated one another.

In FIGS. 1 (A) through 1 (D), the respective fibers composing their own nonwoven fabrics or webs, exist mainly in their own tissues, but some of the fibers may also be get partially into other tissues of layers. Particularly, when many short fibers 2*a* of the layer a are intertwined into other layers b and c, better touch feeling and better appearance are attained.

Figure 2:
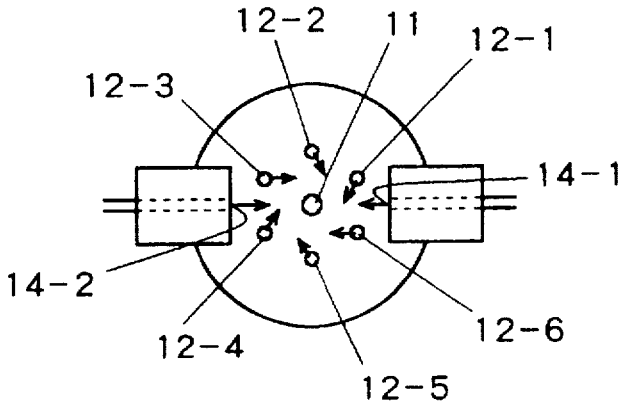
FIGS. 2 (A) through 2 (C) illustrate an example of an apparatus for producing unstretched long fiber nonwoven fabric, in which FIG. 2 (A) is a bottom view of a spinning nozzle, FIG. 2 (B) is a vertical cross-sectional front view of the end portion of the spinning nozzle, and FIG. 2 (C) is a vertical cross-sectional side view of the end portion of the spinning nozzle as shown in FIG. 2 (B)
Figure 2:
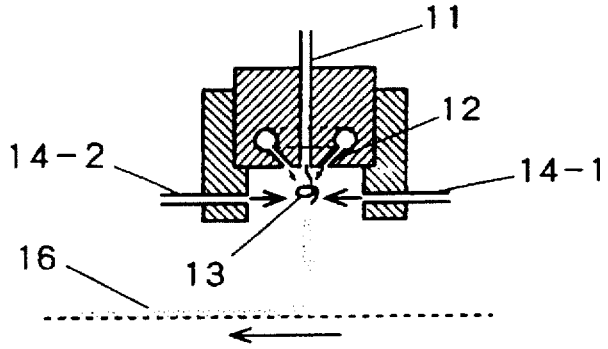
Figure 2:
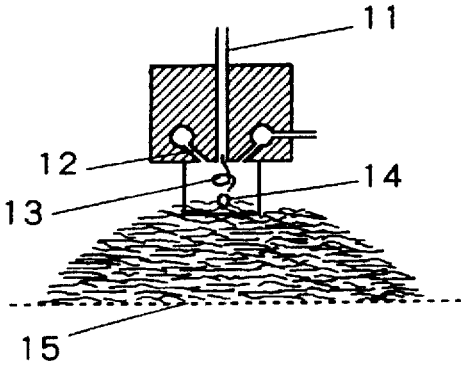

FIGS. 2 (A) through 2 (C) shows an example of a device for producing a long fiber nonwoven fabric which is unstretched and composed of fibers oriented transversely and made of a thermoplastic resin according to the present invention. FIG. 2 (A) is a bottom view showing a spinning nozzle, FIG. 2 (B) is a cross-sectional front view showing the cross-section of the extreme end of the spinning nozzle, and FIG. 2 (C) is a side view showing the cross-section of the extreme end of the spinning nozzle shown in FIG. 2 (B).

A molten liquid for fibers of a nonwoven fabric to be made is discharged from a spinning port 11, which port is surrounded by air holes 12 (12-1 to 12-3). These air holes are opened obliquely, so that the jetted air streams intersect with the molten polymer liquid 13, whereby the molten polymer liquid 13 is spirally rotated. Furthermore, when air is jetted from other two air holes 14-1 and 14-2 disposed on the outer side of the air holes 12. The air streams jetted from both the air holes collide with each other to spread in the direction perpendicular to the air-jetting direction. The rotating spun fibers are scattered perpendicularly to the advancing direction of the nonwoven fabric. The fibers are piled up on a screen mesh 15 which is traveling under the spinning port 11 in a state that most of them are arranged transversely to form a nonwoven fabric 16 that is composed essentially of transversely arranged fibers. In order that discharged fibers spread uniformly along the moving direction of the screen and molecular orientation of them hardly occurs, it is required to heat the jetted air to a temperature higher than the melting point of the polymer to be spun.

When the nozzle of FIG. 2 is turned by 90 degrees to change the pattern of the air from the air holes 14 to a longitudinal direction (parallel to the shifting of the nonwoven fabric) and a number of such nozzles are disposed in a transverse direction, a nonwoven fabric composed of longitudinally arranged fibers may also be produced.

Figure 3:
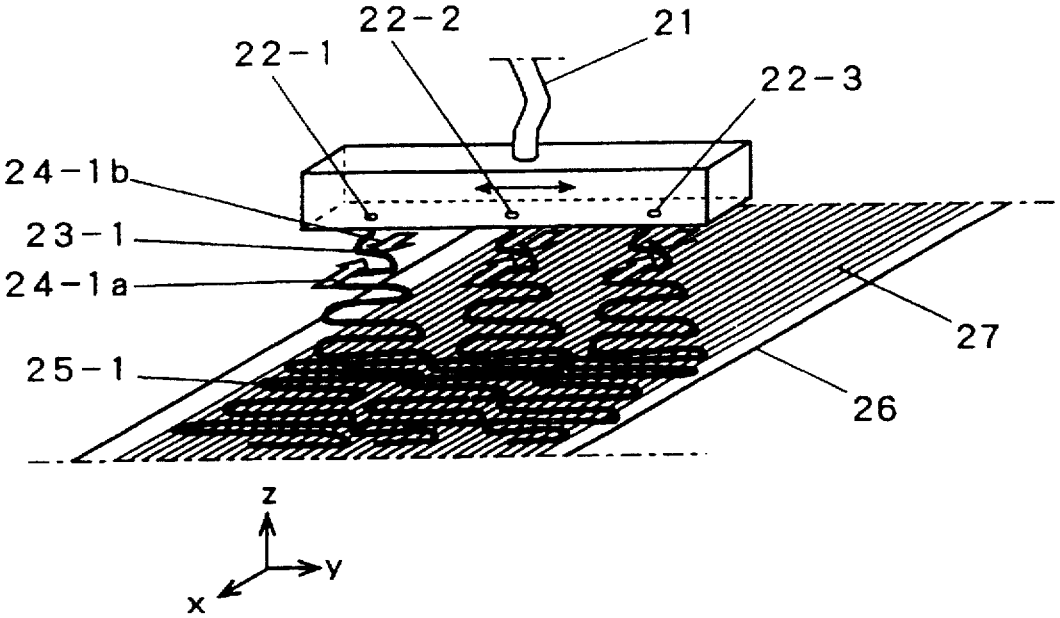
FIG. 3 is a perspective view of another example of an apparatus for producing unstretched long fiber nonwoven fabrics.

FIG. 3 illustrates another example of a method for producing a nonwoven fabric composed of unstretched long fibers spun from a thermoplastic resin according to the present invention. In the first place, a molten polymer is introduced into a group of spinning ports 22-1, 22-2, and 22-3 through a flexible tube 21. These spinning ports are oscillated by means of a driving means (not shown) in the direction parallel to the Y-axis of X, Y, Z-coordinate in the drawing. For instance, a fiber 23-1 thus spun is oscillated along the transverse direction with the same cycle as that of the spinning port. When a pair of opposed fluids 24-1*a* and 24-1*b* supplied from the positions being substantially symmetrical along the X-axis with a center of the fiber 23-1 oscillating in the transverse direction, are allowed to collide with each other, this fiber is scattered by the force derived from the fluids collided along the direction parallel to the Y-axis. The fiber is thus arranged in the direction parallel to the Y-axis as shown by reference numeral 25-1. As a result, the fiber is accumulated on a conveyor belt 26 which is traveling forwards along the direction parallel to the X-axis. Because a group of fibers 27 made by some other method are arranged in a longitudinal direction on a conveyor belt 26, the fibers which are transversely arranged on the conveyor belt are laid in layers on the fibers 27 to produce a nonwoven fabric.

Figure 4:
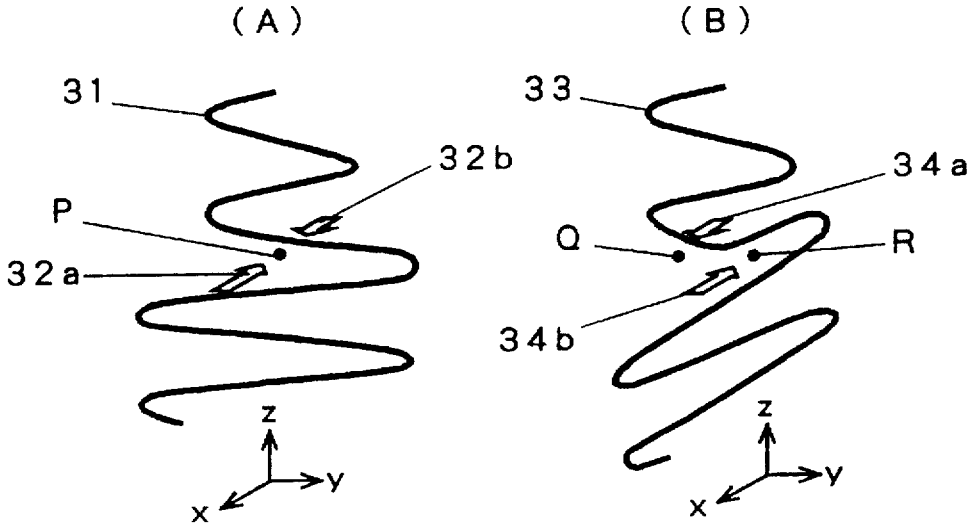
FIGS. 4 (A) and 4 (B) are schematic explanatory illustration each showing an example of a method for scattering fibers in the apparatus shown in FIG. 3.

In the following, a method for scattering the oscillating fibers shown in the above FIG. 3 will be described. There are two methods. In one method, one or more pairs of fluids 32*a* and 32*b* which are opposed substantially symmetrically with each other with the center of an oscillating fiber 31 are allowed to collide with each other on the fiber (at position P), whereby the fiber is scattered in the directions perpendicular to the jetting of fluids as shown in FIG. 4 (A). The other method is such that, as shown in FIG. 4 (B), one or more pairs of fluids 34*a* and 34*b* which are opposed substantially symmetrically with each other and centering around the oscillating fiber 33 are jetted to different positions (positions Q and R) within the oscillating range of the fiber, whereby the fiber is scattered in the directions substantially parallel to the fluid jetting direction.

In many cases, it is desirable that a unidirectionally arranged nonwoven fabric thus prepared is stretched in the oriented direction of the fiber in accordance with a well-known method.

Figure 5:
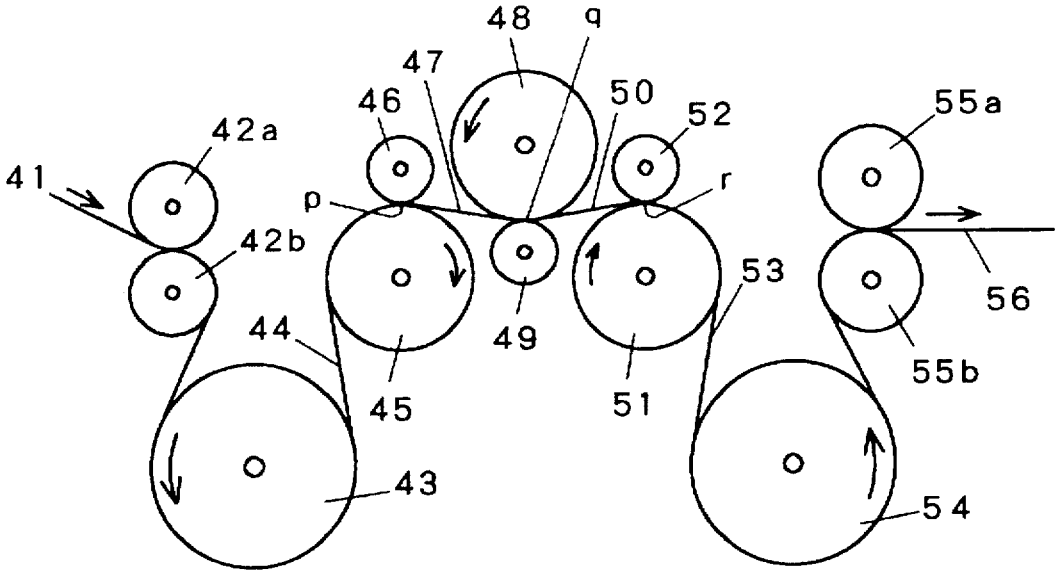
FIG. 5 is a schematic view illustrating an example of a method for producing a stretched nonwoven fabric.

FIG. 5 is a side view schematically illustrating an example of a method for producing a stretched nonwoven fabric. A nonwoven fabric 41 is composed of unstretched fibers made of a thermoplastic resin. The nonwoven fabric 41 is introduced into a stretching device by means of nip rolls 42*a* and 42*b*, preheated on a preheating roll 43, and then introduced to a stretching roll 45 in the form of a nonwoven fabric 44. The stretching roll 45 is provided with a nip roll 46, and longitudinal stretching is carried out between the stretching roll 45 to another stretching roll 48. The distance for stretching corresponds to the traveling distance p–q of the nonwoven fabric which is determined by a nip point p defined by the stretching roll 45 and the nip roll 46 and a nip point q defined by the stretching roll 48 and its nip roll 49. The nonwoven fabric 47 is subjected to one-step stretching in the stretching distance.

When two-step stretching is required, the stretching operation is carried out between the stretching roll 48 and a stretching roll 51. The stretching distance in this case corresponds to a traveling distance q–r of a nonwoven fabric 50 determined by the point q and a nip point r defined by the stretching roll 51 and a nip roll 52.

Although no heat treatment is generally required, the nonwoven fabric 53 may be treated by a heat-trating roll 54 if heat treatment is required in the longitudinal stretching.

The stretched nonwoven fabric 53 is taken off by nip rolls 55*a* and 55*b* to obtain a nonwoven fabric 56.

As the method for longitudinal stretching of the nonwoven fabric, short distance stretching is suitable. If the stretching distance is too long, the ratio of fibers to be stretched becomes low, because the quantity of fibers which are longer than the stretching distance is small among the fibers of the nonwoven fabric and most of fibers are only slip off from each other. For this reason, the greater part of fibers is not stretched resulting in that the spaces among fibers are only enlarged and the thickness is decreased.

Accordingly, a device having a small stretching distance is suitable for longitudinal stretching of nonwoven fabrics. The stretching rolls shown in FIG. 5 are provided with the nip rolls 46, 49, and 52, whereby the starting point of stretching is fixed, so that the stretching operation can be made stable. Thus, the nonwoven fabric can be stretched at a higher stretching ratio. For instance, if the nip roll 46 does not exist, the starting point of stretching shifts from the point p to a point close to the preheating roll 43, so that the stretching distance becomes longer. In addition, the fibers are liable to be torn off as a result of shifting of the starting point of stretching.

With the above described principle, it is desirable that the fibers of a nonwoven fabric are well arranged in a longitudinal direction for the longitudinal stretching. In other words, when the fibers are well arranged in the stretching direction, the ratio of fibers which are held between nip points increases, so that the strength of stretched nonwoven fabric after stretching is improved.

The stretched nonwoven fabric prepared in accordance with the above described method is intertwined with a short fiber web.

Figure 6:
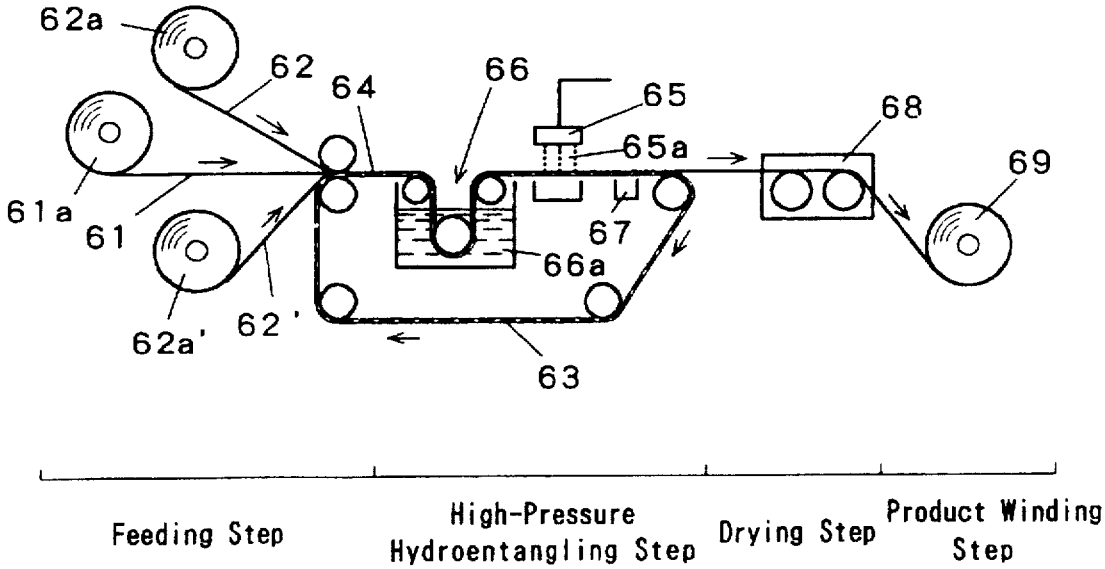
FIG. 6 is a schematic view illustrating a process of hydroentanglement.

FIG. 6 is a schematic view illustrating an example of producing steps for the hydroentanglement. In a feeding step, a short fiber web 62 fed from a feed roll 62*a* is supplied to the upper side of a stretched nonwoven fabric 61 fed from a feed roll 61*a*, or a short fiber webs 62 and 62' fed from feed rolls 62*a* and 62*a'* are supplied to both sides of the stretched nonwoven fabric 61. In another way, a stretched nonwoven fabric fed from the feed rolls is put in layers with a web which is supplied directly from a carding machine in the step to form a short fiber web. The thus obtained laminated nonwoven fabric is transferred to a succeeding high-pressure hydroentanglement step.

In the subsequent hydroentanglement step, a plurality of thin water jet streams 65*a* from a high-pressure water jet injector 65 are applied to the transferred laminate 64 which consists of the short fiber web 62 and the stretched nonwoven fabric 61 on a processing water permeable screen or a processing water impermeable roll as a support 63 for transferred material.

If the superposed short fiber web 62 and stretched nonwoven fabric 61 are slipped off from each other, or they are peeled off from each other due to the energy of the high-pressure water jet, the stability of the intertwining treatment is lost and a uniformly intertwined nonwoven fabric having excellent physical properties cannot be obtained. Accordingly, it is desirable that the laminate 64 is previously dipped into water 66*a* in a water immersion tank 66 before subjecting the laminate to the water jet streams.

After jetting the water streams, it is preferred that moisture is sucked by a moisture aspirator 67 provided with a vacuum aspirating means to remove water content in order to enhance the drying efficiency.

When a water permeable transferring support is used in the above described high-pressure hydroentanglement step, because the processing water is easily removed, it is avoided to damage uniformity in the short fiber web 62 due to the scattering of web by jetting water streams. However, considerable energy still remains in the processing water which is passed through the laminate 64, so that the efficiency in view of energy consumption is not so high. When the high-pressure water jet treatment is carried out on a screen, although the screen is not especially limited, it is desirable that the kind of material, sieve opening, and wire diameter of the screen should be selected for the purposes and manner of use of the screen in order to facilitate the discharging of processing water. The aperture of screen may be usually in the range from 20 to 200 mesh.

Meanwhile, when a processing water impermeable transferring support is employed, the water jet streams once passed through the laminate 64 collide with the transferring support to produce repulsive streams which act again upon the laminate 64. As a result, the effect of intertwinement is enhanced due to the interaction between water jet streams and the repulsive streams. However, because the high-pressure water streams are jetted to the laminate 64 which is floating in water, stability in the intertwinement is poor.

Among the methods described above, it is desirable that the high-pressure water jet treatment is carried out on a processing water permeable transferring support in view of the facts that stable treatment can be done and that a uniform intertwined nonwoven fabric can be obtained.

The pressure of water jet streams in the high-pressure hydroentanglement is in the range from 30 to 300 kg/cm$^2$, and preferably from 60 to 150 kg/cm$^2$. When the pressure is less than 30 kg/cm$^2$, the intertwining effect is insufficient. On the other hand, when it exceeds 300 kg/cm$^2$, the cost of high-pressure water jet increases, in addition, the handling of water jet is difficult, so that both the cases are undesirable.

While water jetting may be carried out once or more, it is preferable to carry out the intertwining treatment by water jetting of two or three times. More particularly, it is possible to carry out the water jetting treatment properly in a separated step, i.e., high-pressure and large water quantity jetting is done for the main purpose of intertwinement, low-pressure and small water quantity jetting is done for the surface finishing treatment, and the intermediate level jetting is done, if necessary.

Meanwhile, the shape of high-pressure water jet is not specifically limited, columnar streams are desirable in view of energy efficiency. The cross-sectional configuration of the water stream is determined by the cross-sectional shape of nozzles or the inner structure in the injection port of nozzles. They are optionally selected depending upon the used materials, purposes, and utilities of short fiber web and stretched nonwoven fabric.

The treating rate of high-pressure water jetting is in the range from 1 to 150 m/min, and preferably from 20 to 100 m/min. When the treating rate is smaller than 1 m/min, the productivity is low. On the other hand, when it exceeds 150 m/min, the intertwining efficiency is insufficient, so that both the cases are undesirable.

The nonwoven fabric which is obtained by intertwining with high-pressure water jet is then transferred to a drying step. In the drying step, the nonwoven fabric is dried by means of, for example, an oven 68, a hot-air oven, or a hot cylinder. In this case, the nonwoven fabric may be previously dehydrated by aspiration prior to the drying, and in the drying step, the above-described nonwoven fabric can be shrunk, if desired.

The nonwoven fabric 69 the thus dried is then taken up in a product winding step.

In the following, a step for applying bulking treatment to the nonwoven fabric which was intertwined, will be described.

Figure 7:
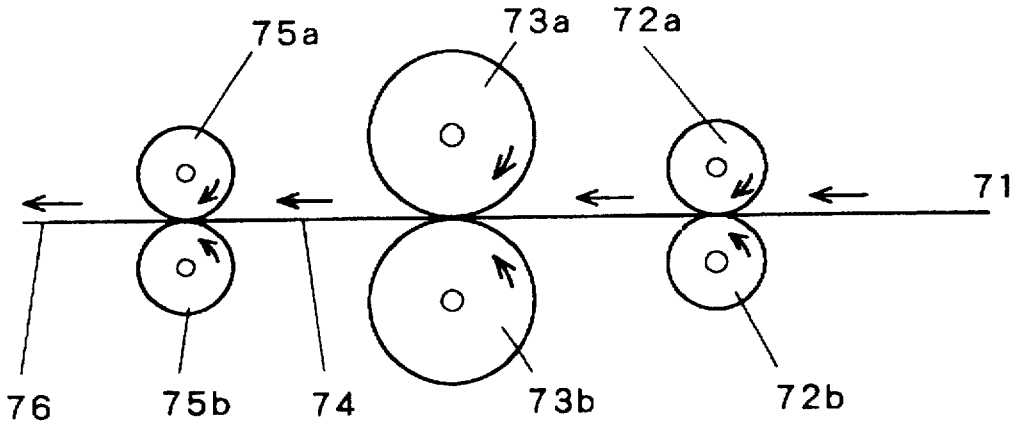
FIG. 7 is a side view schematically illustrating an example of bulky mass forming process through embossing treatment.

FIG. 7 is a side elevation schematically illustrating an example of a bulking treatment in accordance with embossing treatment. The intertwined nonwoven fabric 71 is introduced between a heat-embossing roll **73*a* and its backing roll 73*b* through nip rolls 72*a* and 72*b* so as to shrink the stretched nonwoven fabric with the heat of the embossing roll, in which the intertwined short fiber web is allowed to curl, so that the nonwoven fabric 74 passed through the embossing treatment becomes bulky. Thus, a final bulky nonwoven fabric 76 is obtained through take-off nip rolls 75*a* and 75*b*. In this case, it is required that each circumferential velocity of take-off nip rolls 75*a* and 75*b* is made smaller than that of the embossing roll 73*a* and the backing roll 73*b*. For the backing roll 73*b***, a metal roll, a hard rubber roll, or a cotton roll, a paper roll each having a flat circumferential surface may be employed. In this case, when an embossing roll is also used as the backing roll, larger bulkiness is attained.

EXAMPLES

Examples of the present invention will be described hereinafter.

The testing methods for samples are as follows.

<Strength and Elongation of Nonwoven Fabric>

A sample having 30 mm width and 100 mm chuck distance is prepared using a nonwoven fabric, and measured at a tension speed of 100 mm/min.

The strength is represented by a value (g/d) obtained by dividing a breaking tenacity measured (indicated by gram) by a denier number of the original nonwoven fabric having 30 mm width. As a method for indicating strength, it is also possible to represent it by a breaking tenacity per a certain width (e.g., 30 mm width), or a strength per a unit area (e.g., mm$^2$), but these methods are not appropriate in the case of comparing samples having different basis weight or bulkiness.

<Bulkiness>

Bulkiness is represented by a bulk density (g/cc). That is, a thickness (cm) of a sample is measured under a constant load (300 g/cm$^2$) by using a thickness indicator having 1 cm$^2$ sectional area, and calculated from the following equation by using a basis weight (g/cm$^2$).

$$\text{Bulkiness (g/cc)} = \text{Basis Weight/Thickness}$$

The methods of producing and properties of stretched nonwoven fabrics used in examples of the present invention are shown in Table 1. PP designates polypropylene and PET, polyethylene terephthalate. The PP is obtained by degrading a commercially available resin so as to have a prescribed melt flow rate, and the PET is a commercially available resin without any modification (trade mark: NEH 2031 produced by Unitika Ltd.). In Table 1, MFR designates a melt flow rate (g/10 min) of a resin measured in accordance with JIS K 6758, and $\eta$ is intrinsic viscosity (dl/g).

The method for producing the stretched nonwoven fabrics shown in Table 1 were carried out in accordance with the fully described method in Japanese Patent Publication No. 3-36948 (1991) filed by the present inventors.

Concerning the strength and the elongation in Table 1, only the values in the stretched direction of nonwoven fabrics are shown. In the method for measuring them, each sample was taken from a nonwoven fabric in such a manner that the sample was about 1000 denier along the stretched direction, and the strength and elongation of the sample were measured with twisting about 100 times per meter. The reason why the sample was twisted is that an obtained value does not correspond to the real average value of the strength of fibers because the cohesion among fibers in a stretched nonwoven fabric itself is low. Furthermore, a shrinkage factor of stretched nonwoven fabric indicates the value after leaving a web in hot air in a free state for 3 minutes at 130° C. in the case of PP, and 190° C. in the case of PET, respectively.

TABLE 1

| Nonwoven Fabric | I-1 | I-2 | II-1 | II-2 |
|---|---|---|---|---|
| Kind of Raw Material | PP (MFR*1:152) | PET (η*2:0.73) | PP (MFR:152) | PET (η:0.73) |
| Spinning Apparatus | Spunbond | Melt-blow | Unidirectional arrange'nt | Unidirectional arrange'nt |
| Stretching | | | | |
| Stretching Method | Two-step short distance roll stretching | Two-step short distance roll stretching | Two-step pulley stretching | Two-step pulley stretching |
| Stretching Direction | Longitudinal | Longitudinal | Transversal | Transversal |
| Stretching Temps. (°C.) | 110 135 | 85 115 | 85 105 | 85 110 |
| Stretching Ratio | 8.7 | 6.3 | 6.3 | 6.4 |
| Properties of Stretched nonwoven fabric | | | | |
| Fiber Arrangement | Longitudinal | Longitudinal | Transversal | Transversal |
| Basis Weight (g/m²) | 10 | 7 | 15 | 8 |
| Strength (g/d) | 3.5 | 3.6 | 2.7 | 3.4 |
| Elongation (%) | 32 | 28 | 39 | 25 |
| Shrinkage (%) | 17 | 15 | 15 | 18 |

Notes
*1MFR: Melt flow rate (g/10 min)
*2η: Intrinsic viscosity (dl/g)

<Example 1>

A rayon carded web (10 g in applied quantity of web) was put in layers on the PP longitudinally stretched nonwoven fabric in symbol I-1 of Table 1, and the rayon carded web was intertwined with the nonwoven fabric by the use of a needle punch with care to avoid to break the fibers of stretched nonwoven fabric. Embossing treatment was then applied to the nonwoven fabric thus intertwined at a temperature of 100° C. and a nip pressure of 10 kg/cm². In this case, the speed on the taking-off side was slowed down by 10% relative to the feeding speed of the nonwoven fabric to cause the shrinkage of the stretched nonwoven fabric, thereby preparing a bulky nonwoven fabric. Characteristics in the producing steps and properties of the obtained bulky nonwoven fabric are shown in Table 2.

<Example 2>

In place of the PP longitudinally stretched nonwoven fabric used in Example 1, the PET longitudinally stretched nonwoven fabric of I-2 in Table 1 was used. This fabric was intertwined with a rayon carded web under a water pressure of 50 kg/cm² and 150 kg/cm² through hydroentanglement method. The nonwoven fabric thus intertwined was dried at a temperature of 80° C., which was followed by bulking treatment at a roll temperature of 160° C. under a nip pressure of 10 kg/cm². Characteristics of the producing steps and the properties of the obtained bulky nonwoven fabric are shown in Table 2.

<Example 3>

A stretched nonwoven fabric was prepared by superposing the PP transversely stretched nonwoven fabric of II-1 in Table 1 on the PP longitudinally stretched nonwoven fabric as used Example 1. Water jet intertwinement was carried out in the like manner as in Example 2. The stretched nonwoven fabric thus intertwined was subjected to shrinking likewise at a roll temperature of 100° C. to conduct bulking treatment. Characteristics in the producing steps and the properties of the obtained bulky nonwoven fabric are shown in Table 2.

<Example 4>

In place of the PP longitudinally stretched nonwoven fabric and transversely stretched nonwoven fabric used in Example 3, the PET longitudinally stretched nonwoven fabric of I-2 in Table 1 and the PET transversely stretched nonwoven fabric of II-2 in the same Table were used. The hydroentanglement was carried out in the like manner as in Examples 2 and 3, and the intertwined stretched nonwoven fabric was shrunk at a roll temperature of 160° C. to effect bulking treatment. Characteristics in the producing steps and the properties of the obtained bulky nonwoven fabric are shown in Table 2.

<Examples 5 and 6>

In Example 5, a longitudinally-transversely stretched nonwoven fabric was further put in layers on the surface of the rayon card web of the bulky nonwoven fabric obtained in Example 4. In Example 6, a pulp nonwoven fabric produced by wet method was superposed on the surface of the longitudinally-transversely stretched nonwoven fabric of the bulky nonwoven fabric obtained in Example 4. Both the above obtained materials were subjected to the intertwinement and the bulking treatment in the like manner as in Example 4. Characteristics in the producing steps and the properties of the obtained bulky nonwoven fabrics are shown in Table 2.

TABLE 2

| | Example | | | | | |
|---|---|---|---|---|---|---|
| | 1 | 2 | 3 | 4 | 5 | 6 |
| Kind of Stretched Nonwoven Fabric | | | | | | |
| Longitudinal Fiber Web (A) | I-1 | I-2 | I-1 | I-2 | I-2 | I-2 |
| Transversal Fiber Web (B) | — | — | II-1 | II-2 | II-2 | II-2 |
| Layer Structure | A + Rayon card web | A + Rayon card web | A · B + Rayon card web | A · B + Rayon card web | A · B + Rayon card web + A · B | Pulp + A · B + Rayon card web |
| Entanglement Method | Needle punch + Embossing | Water jet + Embossing | Water jet + Embossing | Water jet + Embossing | Water jet + Embossing | Water jet + Embossing |
| Properties of | | | | | | |

TABLE 2-continued

| | Example | | | | | |
|---|---|---|---|---|---|---|
| | 1 | 2 | 3 | 4 | 5 | 6 |
| Bulky Non-woven Fabric | | | | | | |
| Basis wt. ($g/m^2$) | 25 | 25 | 35 | 35 | 48 | 48 |
| Strength (g/d) | | | | | | |
| Longitudinal | 1.8 | 1.9 | 1.9 | 2.0 | 1.8 | 1.8 |
| Transversal | — | — | 1.9 | 2.0 | 1.8 | 1.8 |
| Elongation (%) | | | | | | |
| Longitudinal | 9 | 9 | 7 | 8 | 8 | 8 |
| Transversal | — | — | 7 | 8 | 8 | 8 |
| Bulkiness (g/cc) | 0.05 | 0.05 | 0.07 | 0.07 | 0.08 | 0.08 |

<Comparative Examples 1 to 3>

For comparison purpose, the respective properties of a longitudinally-latitudinally laminated nonwoven fabric composed of stretched nonwoven fabrics without using polymer of different shrinking property which was made by a conventional method, (Japanese Patent Publication No. 3-36948 (1991)), a conventional spun-bonded nonwoven fabric of a long fiber type, and a melt-blow nonwoven fabric, are shown in Table 3.

TABLE 3

| | Comparative Example | | |
|---|---|---|---|
| | 1 | 2 | 3 |
| Kind of Nonwoven Fabric | I-1 + II-2 | Spunbonded nonwoven fabric | Melt-blown nonwoven fabric |
| Raw Material Resin | PET | PET | PP |
| Intertwining | Thermal Embossing | Thermal Embossing | — |
| Properties of Nonwoven fabric | | | |
| Basis wt. ($g/m^2$) | 15 | 52 | 31 |
| Strength (g/d) | | | |
| Longitudinal | 1.4 | 0.5 | 0.2 |
| Transversal | 1.3 | 0.1 | 0.1 |
| Elongation (%) | | | |
| Longitudinal | 14 | 28 | 15 |
| Transversal | 12 | 25 | 23 |
| Bulkiness (g/cc) | 0.44 | 0.11 | 0.06 |

As described above, the bulky nonwoven fabric which is made according to the present invention is excellent in bulkiness and also has excellent uniformity in strength, dimensional stability, and basis weight. Furthermore, the method for producing the bulky nonwoven fabric according to the present invention requires neither a conjugate spinning device nor a mixed spinning device, which have been necessitated in the conventional method for producing bulky nonwoven fabrics. While, it is possible in the present invention to produce the bulky nonwoven fabric using a simplified device by combining plural layers of webs each having different shrink characteristics. Accordingly, the producing method of the present invention does not require any expensive cost for equipment, in addition, it is suitable as a flexible producing system for producing a wide variety of products in relatively small quantities. Accordingly, the present invention provides excellent advantages in that low cost production of practical applicability can be attained.

It will be appreciated by those of ordinary skill in the art that the present invention can be embodied in other specific forms without departing from the spirit or essential characteristics thereof.

The presently disclosed embodiments are, therefore, considered in all respects to be illustrative and not restrictive. The scope of the invention is indicated by the appended claims rather than the foregoing description.

What is claimed is:

1. A bulky nonwoven fabric comprising:

a stretched nonwoven fabric prepared from either at least one layer of a stretched unidirectionally arranged filament web which is composed of almost unidirectionally arranged long fibers made by stretching and then shrinking or a stretched crosswise laminated filament web which is made by crosswise superposing two or more layers of said stretched unidirectionally arranged filament webs, and a short fiber web, the fibers of which are entangled with said stretched filament web and are crimped as the result of shrinkage of said long fibers.

2. The bulky nonwoven fabric as claimed in claim 1, wherein said stretched unidirectionally arranged filament web has a stretching ratio in the range from 3 to 20, an average fineness from 0.01 to 10 denier, and a basis weight from 1 to 80 $g/m^2$.

3. A bulky nonwoven fabric which is produced by entangling:

a stretched filament web composed of either at least one layer of a stretched unidirectionally arranged filament web which is prepared by unidirectionally stretching a long fiber filament web spun from a thermoplastic resin and the fibers of which fabric are almost unidirectionally arranged or a stretched crosswise laminated filament web prepared by crosswise superposing said stretched unidirectionally arranged filament webs, and a short fiber web made of a natural fiber, a regenerated fiber or a synthetic fiber, and then the obtained entangled nonwoven fabric is heat-treated to shrink the long fibers of said stretched filament web and to crimp the short fibers of said short fiber web.

4. A method for producing a bulky nonwoven fabric which comprises the steps of:

superposing and entangling a short fiber web with a stretched filament web composed of either at least one layer of a stretched unidirectionally arranged filament web in which the stretched long fibers are almost unidirectionally arranged or a stretched crosswise laminated filament web prepared by superposing two or more of said stretched unidirectionally arranged filament webs, and heat-treating the obtained entangled nonwoven fabrics to shrink the long fibers of said stretched filament web and to crimp the short fibers of said short fiber web.

5. The method for producing a bulky nonwoven fabric as claimed in claim 4, wherein said stretched unidirectionally arranged filament web is prepared by unidirectionally stretching a filament web composed of unstretched long fibers spun from a thermoplastic resin, and the long fibers of said nonwoven fabric are arranged almost in one direction.

6. The method for producing a bulky nonwoven fabric as claimed in claim 4, wherein said entanglement is carried out by laminating or laying down a short fiber web on said stretched filament web, and hydroentangling with high-pressure water jet of 10 to 300 kg/cm$^2$.

7. The method for producing a bulky nonwoven fabric as claimed in claim 4, wherein said stretched unidirectionally arranged filament web has a stretching ratio of 3 to 20, an average fineness of 0.01 to 10 denier, and a basis weight of 1 to 80 g/m$^2$.

8. The method for producing a bulky nonwoven fabric as claimed in claim 4, wherein said stretched nonwoven fabric is made of polyolefin or polyester and is 15% or more in the absolute value of shrinkage factor, said short fiber web is made of a natural fiber, a regenerated fiber, or a synthetic fiber and is 5% or less in the absolute value of shrinkage factor.

9. The method for producing a bulky nonwoven fabric as claimed in claim 4, wherein said stretched unidirectionally arranged filament web is produced by unidirectionally stretching a long fiber web which is composed of unstretched long fibers made by spinning a thermoplastic resin, the long fibers composing said long fiber web being so stretched as to cause substantially the molecular orientation.

10. The method for producing a bulky nonwoven fabric as claimed in claim 4, wherein said stretched unidirectionally arranged filament web is prepared by revolving or laterally vibrating the fibers prepared by spinning out a thermoplastic resin from a spinneret, applying at least one pair of fluids opposed substantially symmetrically to the center of a revolving or vibrating single filament from both sides in a state where the filament is still stretched at a degree of two or more, thereby scattering said fiber in the direction perpendicular to the spinning direction with drafting, arranging fibers in the direction of the scattering to form an arranged filament web, and stretching the arranged filament web in the direction of the arrangement of fibers.

* * * * *

UNITED STATES PATENT AND TRADEMARK OFFICE

CERTIFICATE OF CORRECTION

PATENT NO. : 5,789,328

DATED : August 4, 1998

INVENTOR(S) : Kazuhiko Kurihara, et al.

It is certified that error appears in the above-identified patent and that said Letters Patent are hereby corrected as shown below:

Column 10, Line 5 & 6: "a, a layer b, and a layer a'" should read --a, a layer b , and a layer a'--
Column 10, Line 7: "The layer b is" should read --The layer b is--
Column 10, Line 9: "layer a are" should read --layer a are--
Column 10, Line 11: "layer a' is" should read --layer a' is--
Column 10, Line 13: "layer a" should read --layer a--
Column 10, Line 16: "layer a is combined with layer c" should read --layer a is combined with layer c--
Column 10, Line 18: "layer c" should read --layer c--
Column 10, Line 23: "layer c" should read --layer c--
Column 10, Line 27: "layer c is combined with the layers a and a'" should read --layer c is combined with the
Column 10, Line 27: "layer c is combined with the layers a and a'" should read --layer c is combined with the layers a and a'--
Column 10, Line 33: "layer a" should read --layer a--
Column 10, Line 34: " layers b and c" should read --layers b and c--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*